US012735213B2

(12) United States Patent
Haidacher et al.

(10) Patent No.: US 12,735,213 B2
(45) Date of Patent: Sep. 15, 2026

(54) DEVICE AND METHOD FOR APPLYING PACKAGING FILM TO GROUPS OF ARTICLES

(71) Applicant: Krones Aktiengesellschaft, Neutraubling (DE)

(72) Inventors: Peter Haidacher, Kiefersfelden (DE); Herbert Spindler, Niedermoosen (DE); Juergen Werner, Bruckmuehl (DE); Peter Koch, Rohrdorf (DE); Florian Kochinke, Stephanskirchen (DE)

(73) Assignee: Krones Aktiengesellschaft, Neutraubling (DE)

( * ) Notice: Subject to any disclaimer, the term of this patent is extended or adjusted under 35 U.S.C. 154(b) by 0 days.

(21) Appl. No.: 18/806,117

(22) Filed: Aug. 15, 2024

(65) Prior Publication Data

US 2025/0058914 A1 Feb. 20, 2025

(30) Foreign Application Priority Data

Aug. 17, 2023 (DE) ..... 10 2023 122 016.0

(51) Int. Cl.
*B65B 11/10* (2006.01)
*B65B 27/04* (2006.01)
*B65B 41/02* (2006.01)

(52) U.S. Cl.
CPC ..... *B65B 11/10* (2013.01); *B65B 27/04* (2013.01); *B65B 41/02* (2013.01)

(58) Field of Classification Search
CPC ..... B65B 11/10; B65B 11/20; B65B 27/04; B65B 41/02
(Continued)

(56) References Cited

U.S. PATENT DOCUMENTS 3,791,100 A * 2/1974 Monaghan ..... B65B 41/12 53/389.5
3,791,101 A * 2/1974 Monaghan ..... B65B 11/12 53/389.5
(Continued)

FOREIGN PATENT DOCUMENTS

DE 2247293 A1 3/1974
DE 102009003556 A1 * 9/2010 ..... B65H 23/26
(Continued)

OTHER PUBLICATIONS

European Search Report (EESR) dated Feb. 5, 2025.
Priority Application: DE 10 2023 122 016.0 Filed: Aug. 17, 2023—German Search Report dated Apr. 19, 2024.

*Primary Examiner* — Joshua G Kotis
(74) *Attorney, Agent, or Firm* — Simmons Perrine PLC

(57) ABSTRACT

A device (1) for applying packaging film to groups of articles (12) comprises a horizontal conveyor (5) for transporting groups of articles (12) and a feed apparatus (15) which introduces pieces of cut packaging film (14) into a transport path of the groups of articles (12. A plurality of wrapping rods (30) move in a rotary fashion such that they take up a remaining free portion (17) of the piece of cut packaging film (14) and guide it around the group of articles (12) each time. A flow generating apparatus (40) generates at least one air flow and blows a remaining free portion (17) of the piece of cut packaging film (14), which has already been taken up by a wrapping rod (30), toward the group of articles (12) each time.

9 Claims, 3 Drawing Sheets

(58) Field of Classification Search
USPC ..... 53/210
See application file for complete search history.

(56) References Cited

U.S. PATENT DOCUMENTS

| | | | | | |
|---|---|---|---|---|---|
| 4,706,444 | A * | 11/1987 | Gambetti | B65B 11/10 | 53/389.5 |
| 5,189,865 | A * | 3/1993 | Andrade | B65B 25/14 | 53/228 |
| 5,203,144 | A * | 4/1993 | Gambetti | B65B 11/10 | 53/210 |
| 2002/0073649 | A1* | 6/2002 | Gamberini | B65B 63/02 | 53/376.2 |
| 2005/0193693 | A1* | 9/2005 | Chao | B65B 11/10 | 53/589 |
| 2012/0018035 | A1* | 1/2012 | Koch | B65B 11/08 | 141/82 |
| 2016/0176552 | A1* | 6/2016 | Lelie | B65B 21/245 | 53/461 |
| 2022/0009658 | A1* | 1/2022 | Stuhlmann | B65B 5/06 | |
| 2022/0281624 | A1* | 9/2022 | Wagner | B65B 13/22 | |

FOREIGN PATENT DOCUMENTS

| | | | | |
|---|---|---|---|---|
| DE | 102016220760 | A1 | 4/2018 | |
| DE | 102016225223 | A1 | 6/2018 | |
| DE | 102017114024 | A1 | 12/2018 | |
| EP | 3336000 | A1 * | 6/2018 | B65B 53/00 |
| JP | 2008114927 | A | 5/2008 | |

* cited by examiner

Prior art

DEVICE AND METHOD FOR APPLYING PACKAGING FILM TO GROUPS OF ARTICLES

CLAIM OF PRIORITY

The present application claims priority to German Application 10 2023 122 016.0, filed Aug. 17, 2023, which is incorporated by reference.

FIELD OF THE INVENTION

The present invention relates to a device and to a method for applying packaging film to groups of articles.

BACKGROUND OF THE INVENTION

When packaging articles such as containers into packs, several articles are often grouped together and wrapped in film in this grouped arrangement, after which the film can be fixed at overlapping points and/or to the articles and/or shrunk around the articles by the action of heat in order to ensure strong mechanical cohesion of the articles combined to form a pack in this way. These packs, which can be formed, for example, by four or six beverage containers that are wrapped in shrink film and thus mechanically stabilized, can be stacked and/or palletized and can also serve as finished sales units that can be made available to the consumer in this easy-to-handle form.

In order to be able to produce packs of articles, groups of articles are first formed which comprise a plurality of articles intended for one pack. In order to be able to subsequently wrap a group of articles with film, pieces of cut film are introduced into the transport path of the groups of articles such that a group of articles moves onto a cut piece each time during a continuous movement. Each cut piece is then guided around each group of articles by wrapping rods that are moved in a rotary fashion, whereupon the group of articles, together with the blank, enters a shrink tunnel. There, each cut piece is shrunk onto each group of articles.

Such a device is already disclosed, for example, in DE 10 2017 114 024 A1. The device disclosed in the DE document comprises a film wrapping device which wraps groups of articles with a portion of film having a specific length. The film wrapping device comprises a plurality of wrapping rods and a guide apparatus for the plurality of wrapping rods.

If a cut piece is applied to a group of articles in this way, successive groups of articles must hitherto have a relatively large spacing from one another in the transport direction in order to prevent successive groups of articles from moving onto the same piece of cut packaging film. A large relative distance between successive groups of articles leads to reduced throughput of the device when correspondingly packaging groups of articles using a piece of cut packaging film each time. In addition, devices have a large or extensive structure, since a horizontal conveyor intended for transporting a plurality of groups of articles must have a large extension to be able to accommodate a plurality of groups of articles that are at a large relative spacing from one another.

For this reason, one object of the invention can be considered that of providing a device for applying packaging film to groups of articles, which can operate with high throughput and also has a compact design. Furthermore, one object of the invention can be considered that of providing a corresponding method with which packaging film can be applied to groups of articles with high throughput, for which less space is required.

The above objects are achieved by the subject matter that comprises the features in the independent claims. Advantageous embodiments are described in the dependent claims.

SUMMARY OF THE INVENTION

The invention relates to a device for applying packaging film to groups of articles. A group of articles can be formed of at least two articles. For example, each group of articles may contain exactly four articles, exactly six articles or exactly eight articles.

A group of articles may be designed as a group of beverage containers. In this case, a group of beverage containers may be formed from at least two beverage containers. For example, each group of beverage containers may comprise exactly four beverage containers, exactly six beverage containers or exactly eight beverage containers. Each beverage container can be designed as a beverage bottle or as a beverage can.

The device comprises at least one horizontal conveyor for transporting groups of articles. The at least one horizontal conveyor can be connected to a control apparatus designed to control the at least one horizontal conveyor for continuous or uninterrupted movement of the groups of articles.

The device further comprises a feed apparatus, which is designed to introduce pieces of cut packaging film into a transport path of the groups of articles transported via the at least one horizontal conveyor such that a group of articles moves onto a portion of a piece of cut packaging film introduced into the transport path each time and a further portion of the piece of cut packaging film remains free. During operation of the device, the feed apparatus can be arranged below the at least one horizontal conveyor.

In various embodiments, the device can comprise a separating and/or cutting station, via which pieces of cut packaging film can be separated from a continuous section of packaging film and transported in the direction of the feed apparatus.

The device also comprises a plurality of wrapping rods that are moved in a rotary fashion so as to take up a remaining free portion of the piece of cut packaging film and guide it around the group of articles each time. The device may comprise at least two chains and/or belts oriented in parallel with one another and each moving in a rotary fashion, wherein a wrapping rod is arranged on the at least two parallel chains and/or belts each time and is moved in a rotary fashion by the at least two parallel chains and/or belts. The plurality of wrapping rods may continuously rotate or the plurality of wrapping rods may never stop.

The device comprises a flow generating apparatus which is designed to generate at least one air volume flow or air flow or which is configured, equipped and/or arranged to generate at least one air flow, via which a remaining free portion of the piece of cut packaging film which has already been taken up by a wrapping rod can be blown toward the group of articles each time. In particular, the device may comprise a flow generating apparatus which is designed to generate at least one air flow or which is configured, equipped and/or arranged to generate at least one air flow, via which a remaining free portion of the piece of cut packaging film which has already been taken up by a wrapping rod can be blown toward the group of articles each time in such a way that the remaining free portion of the piece of cut packaging film which has already been taken up by a wrapping rod thereby comes into surface contact with the group of articles, at least in some regions.

Alternatively or in addition thereto, the device may comprise a flow generating apparatus which is designed to generate at least one air flow or which is configured, equipped and/or arranged to generate at least one air flow, via which a remaining free portion of the piece of cut packaging film which has already been taken up by a wrapping rod can be blown toward the group of articles each time such that at least regions of the piece of cut packaging film are thereby pulled out of a gap, which gap is formed between a first transport apparatus and a second transport apparatus of the at least one horizontal conveyor and is intended for introducing pieces of cut packaging film by the feed apparatus.

By blowing the piece of cut packaging film toward each group of articles, the range of the piece of cut packaging film in the direction of a subsequent group of articles can be shortened. This allows successive groups of articles to be moved at a small relative distance from one another along the at least one horizontal conveyor without successive groups of articles unintentionally moving onto the same piece of cut packaging film. Since a plurality of groups of articles can therefore be transported by the at least one horizontal conveyor within a given time, the device has a high throughput when applying packaging film to groups of articles. Even very short distances are sufficient to be able to collectively move a plurality of groups of articles by the at least one horizontal conveyor. The device is therefore also characterized by a very compact design.

Embodiments in which the at least one horizontal conveyor comprises a first transport apparatus and a second transport apparatus, wherein the second transport apparatus follows the first transport apparatus in a transport direction of the groups of articles, have proven successful. In this case, a gap can be formed between the first transport apparatus and the second transport apparatus, through which pieces of cut packaging film can be introduced into the transport path of the groups of articles by the feed apparatus. The first transport apparatus and/or the second transport apparatus can each comprise a rotatably driven conveyor for groups of articles. The rotatably driven conveyor can, for example, be a rotatably driven conveyor belt or a rotatably driven mat chain. The flow generating apparatus may also comprise at least one nozzle by which at least one air flow can be delivered such that the at least one air flow is directed with its main flow direction toward an end region of the second transport apparatus arranged in the region of the gap. Practice has shown that in such embodiments the at least one air flow moves along the rotatably driven conveyor, whereby the remaining free portion of the piece of cut packaging film is raised and can be easily blown in the direction of the group of articles each time.

In particular, the second transport apparatus may have a substantially cylindrical deflection in its end region, wherein the rotatably driven conveyor forms the tight side or the drive side of the second transport apparatus after passing the deflection. The at least one air flow may be deliverable via the at least one nozzle of the flow generating apparatus such that the at least one air flow is directed with its main flow direction toward the deflection. With such embodiments, the technical effect already mentioned above, according to which the at least one air flow moves along the rotatably driven conveyor and thereby raises the remaining free portion each time, can be further improved.

As already mentioned above, the at least one horizontal conveyor may comprise a first transport apparatus and a second transport apparatus, wherein the second transport apparatus follows the first transport apparatus in a transport direction of the groups of articles and wherein a gap is formed between the first transport apparatus and the second transport apparatus, via which pieces of cut packaging film can be introduced into the transport path of the groups of articles by the feed apparatus. In such embodiments, the flow generating apparatus may comprise at least one first nozzle and at least one second nozzle, via each of which at least one air flow can be delivered in such a way that the at least one air flow is directed with its main flow direction toward an end region of the second transport apparatus arranged in the region of the gap each time. Furthermore, the at least one air flow delivered by the at least one first nozzle may impinge on a first broad side surface of the remaining free portion of the piece of cut packaging film that has already been taken up by a wrapping rod, and the air flow delivered by the at least one second nozzle may impinge on a second broad side surface of the remaining free portion of the piece of cut packaging film that has already been taken up by a wrapping rod, which second broad side surface is opposite the first broad side surface.

As has already been mentioned above, the second transport apparatus may have a deflection with a substantially cylindrical shape in its end region, wherein the rotatably driven conveyor forms the tight side or the drive side of the second transport apparatus after passing the deflection. The at least one air flow delivered by the at least one first nozzle and the air flow delivered by the at least one second nozzle may be directed toward the deflection with their respective main flow directions.

The at least one first nozzle and the at least one second nozzle can be arranged below a transport plane formed by the at least one horizontal conveyor.

Furthermore, the flow generating apparatus may comprise a first tube by which the at least one first nozzle is formed. Alternatively or additionally thereto, the flow generating apparatus may comprise a second tube which forms the at least one second nozzle.

The flow generating apparatus can comprise at least one flow baffle which is arranged such that the air flow delivered by the at least one first nozzle is deflected by the at least one flow baffle such that the air flow delivered by the at least one first nozzle is directed with its main flow direction toward the end region of the second transport apparatus arranged in the region of the gap and impinges on the second broad side surface of the remaining free portion of the piece of cut packaging film which has already been taken up by a wrapping rod in each instance.

The feed apparatus can comprise a steering apparatus for guiding pieces of cut packaging film, which steering apparatus forms a surface that is curved at least in portions and across which an airflow passes, and along which steering apparatus each piece of cut packaging film is moved before it reaches the flow generating apparatus.

The device may comprise a control device used to control the flow generating apparatus to intermittently generate the at least one air flow.

The invention also relates to the use of a device according to one embodiment of the preceding description for applying packaging film to groups of articles, which packaging film is a thermoplastic packaging film.

The invention further relates to a method for applying packaging film to groups of articles, in which method groups of articles are moved via at least one horizontal conveyor and a feed apparatus introduces pieces of cut packaging film into a transport path of the groups of articles such that a group of articles moves onto a portion of a piece of cut packaging film introduced into the transport path each time and a further portion of the piece of cut packaging film remains free. The device already described above can be designed to carry out the embodiments of the method according to the invention described below.

In the method, a plurality of wrapping rods are provided, each wrapping rod of which receives a remaining free portion of a piece of cut packaging film and guides it around the group of articles each time. The method provides that a remaining free portion of the piece of cut packaging film which has already been taken up by a wrapping rod is blown toward the group of articles each time by at least one air flow provided by the flow generating apparatus.

The at least one horizontal conveyor can comprise a first transport apparatus and a second transport apparatus, wherein the second transport apparatus follows the first transport apparatus in a transport direction of the groups of articles and wherein a gap is formed between the first transport apparatus and the second transport apparatus, via which pieces of cut packaging film are introduced into the transport path of the groups of articles by the feed apparatus. Furthermore, at least one air flow can be delivered by at least one nozzle of the flow generating apparatus in such a way that the at least one air flow is directed with its main flow direction toward an end region of the second transport apparatus arranged in the region of the gap.

As already mentioned above, the at least one horizontal conveyor may have a first transport apparatus and a second transport apparatus, wherein the second transport apparatus follows the first transport apparatus in a transport direction of the groups of articles, and wherein a gap is formed between the first transport apparatus and the second transport apparatus, via which pieces of cut packaging film are introduced into the transport path of the groups of articles by the feed apparatus. In this case, the flow generating apparatus may have at least one first nozzle and at least one second nozzle, via each of which at least one air flow is delivered in such a way that the at least one air flow is directed with its main flow direction toward an end region of the second transport apparatus arranged in the region of the gap each time. Furthermore, in each instance the at least one air flow delivered by the at least one first nozzle may impinge on a first broad side surface of the remaining free portion of the piece of cut packaging film that has already been taken up by a wrapping rod, and the air flow delivered by the at least one second nozzle may impinge on a second broad side surface of the remaining free portion of the piece of cut packaging film that has already been taken up by a wrapping rod, which second broad side surface is opposite the first broad side surface.

Furthermore, the flow generating apparatus may have at least one flow baffle, via which the air flow delivered by the at least one first nozzle is deflected such that the air flow delivered by the at least one first nozzle is directed with its main flow direction toward the end region of the second transport apparatus arranged in the region of the gap and impinges on the second broad side surface of the remaining free portion of the piece of cut packaging film which has already been taken up by a wrapping rod.

In various embodiments, the feed apparatus may also comprise a steering apparatus for guiding pieces of cut packaging film, which steering apparatus forms a surface that is curved at least in portions and across which an airflow passes, and along which steering apparatus each piece of cut packaging film moves before it reaches the flow generating apparatus.

BRIEF DESCRIPTION OF THE FIGURES

Embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

Figure 1:
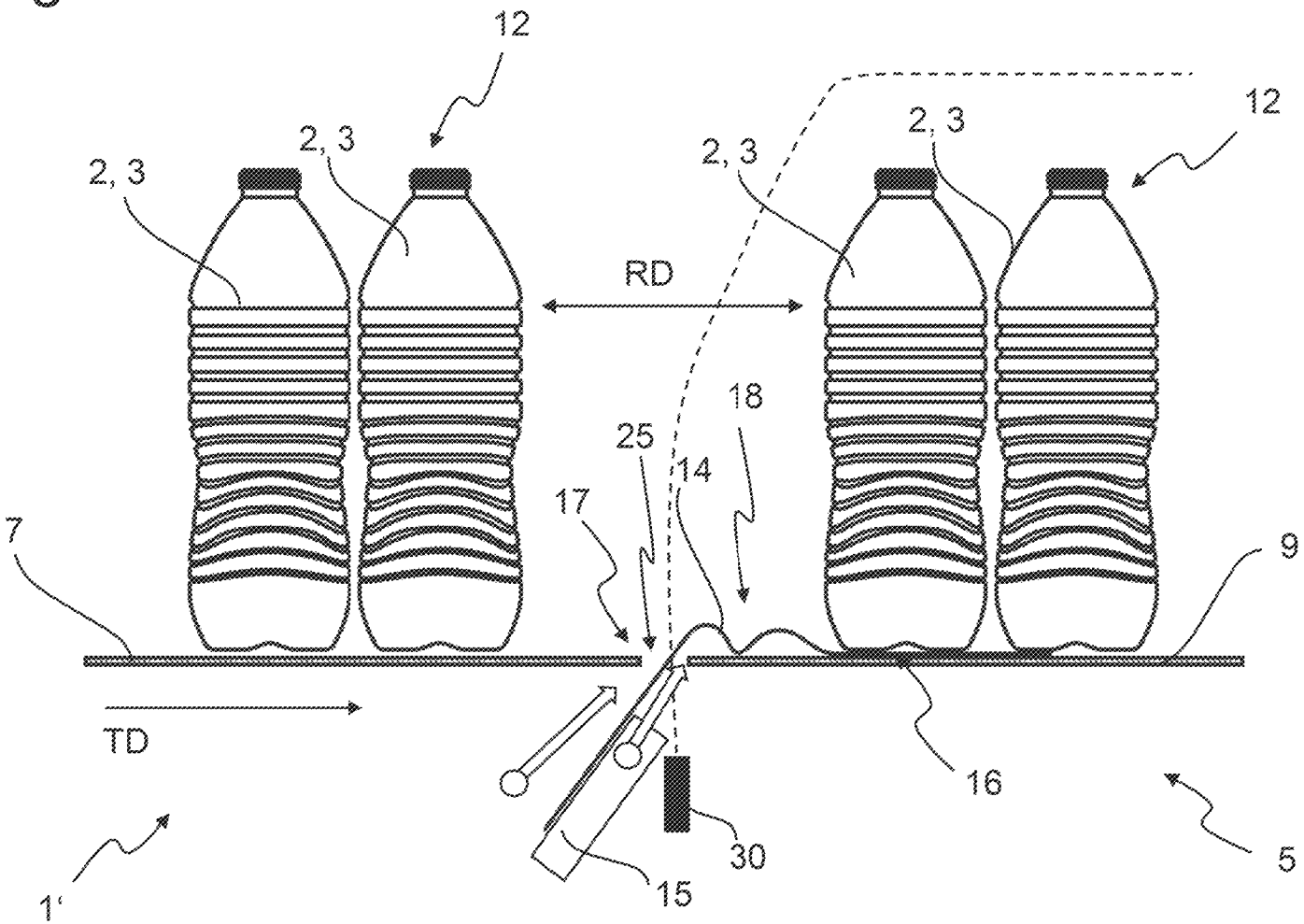
FIG. 1 is a schematic view of a device already known in the art and of a method already known in the art.

Identical reference numerals are used for identical elements of the invention or those having the same effect. Furthermore, for the sake of clarity, only reference signs are shown in the individual figures, which are required for the description of the respective figure. The illustrated embodiments are merely examples of how the invention can be designed, and are non-limiting.

At this point, it should also be emphasized that features described above for embodiments of the device according to the invention can also relate to, or form, partial aspects of the method according to the invention. Therefore, if at any point in the description or the definitions of the claims reference is made to an embodiment of the device according to the invention, this likewise applies to the embodiments of the method according to the invention. The same applies vice versa so that all aspects and variants that have been explained in connection with embodiments of the method according to the invention can also likewise relate to, or form, partial aspects of the device according to the invention. Therefore, if at any point in the description or the definitions of the claims relating to the device according to the invention reference is made to specific advantages and effects, this likewise applies to the embodiments of the method according to the invention. It is also possible that various embodiments of the method according to the invention are implemented or carried out by an embodiment of the device according to the invention.

DETAILED DESCRIPTION OF THE INVENTION

FIG. 1 is a schematic view of a device 1' already known from the prior art and illustrates a procedure of a method for packaging articles 2 already known from the prior art. Articles 2, which in the present case are formed by beverage bottles 3, are regularly sold in stores as so-called packs, in each of which a plurality of articles 2 are combined by a packaging device and are held together by the packaging device. For example, packs of six or six packs are known as sales units which comprise exactly six articles 2 held together by an appropriate packaging device. Packs of two or more than six articles 2 may also be provided as sales units.

In order to be able to produce a pack with a plurality of articles 2, the articles 2 intended for one pack are first combined into a group of articles 12, which has a corresponding number of articles 2. For this purpose, dividers are used which briefly accelerate the articles 2 intended for a particular pack with respect to subsequent articles 2, whereby the leading articles 2 are spaced apart from the trailing articles 2 and a group of articles 12 is created. Two such groups of articles 12 can already be seen in FIG. 1. The groups of articles 12 are moved in the transport direction TD via the horizontal conveyor 5, wherein the horizontal conveyor 5 is formed in the present case by a first transport apparatus 7 and a second transport apparatus 9. As can also be seen from FIG. 1, a gap 25 is formed between the first transport apparatus 7 and the second transport apparatus 9. The feed apparatus 15 introduces pieces of cut packaging film 14 into a transport path of the groups of articles 12 so that a group of articles 12 moves onto a portion 16 of a piece of cut packaging film 14 each time. The group of articles 12 shown on the right in FIG. 1 has already moved onto the portion 16 of the piece of cut packaging film 14. A remaining free portion 17 of the piece of cut packaging film 14 is yet to be introduced into the transport path of the group of articles 12 by the feed apparatus 15. Devices l' according to FIG. 1, which are already known from the prior art, also comprise a plurality of wrapping rods 30, which are moved in a rotary fashion and take up the remaining free portion 17 of a piece of cut packaging film 14 and place it around the group of articles 12 each time, as indicated by the dashed line. The group of articles 12 once again moves onto the portion 17 which has remained free until now and which has already been placed around the group of articles 12 such that the piece of cut packaging film 14 completely encloses a group of articles 12 each time. Following this, the group of articles 12 can be moved into a shrink tunnel together with the piece of cut packaging film 14, whereby the piece of cut packaging film 14 is shrunk onto the articles 2 of the group of articles 12 each time and a pack is formed consisting of the group of articles 12 and the shrunk piece of cut packaging film 14.

As can be seen from FIG. 1, a certain relative distance RD is formed between individual groups of articles 12 which follow one another in the transport direction TD. This relative distance RD is necessary so that the group of articles 12 shown on the left in FIG. 1 does not inadvertently move onto the remaining portion 17 of the piece of cut packaging film 14 that is still free, with the bottom of which the group of articles 12 shown on the right in FIG. 1 is already in contact. However, in order to be able to operate a device 1' with high throughput, it would be desirable if the relative distance RD between successive groups of articles 12 could be reduced in order to be able to provide a larger number of groups of articles 12 with packaging film per unit of time.

As already shown in FIG. 1, in devices 1' known from the prior art, it can therefore already be the case that the feed apparatus 15 is operated at a high conveying speed, whereby a film bag 18 is formed on the second transport apparatus 9. Since the material of the piece of cut packaging film 14 thereby collects on the second transport apparatus 9, the relative distance RD between successive groups of articles 12 can already be reduced to a certain extent without the group of articles 12 shown on the left in FIG. 1 unintentionally moving onto the piece of cut packaging film 14 which is intended for the group of articles 12 shown on the right in FIG. 1. The formation of such a film bag 18 is often not enough to be able to exclude with certainty that a subsequent group of articles 12 will not inadvertently move onto the flat blank 14. In addition, it would be desirable for the relative distance RD between successive groups of articles 12 to be further reducible in order to be able to increase the throughput of the device 1'. A corresponding film bag 18 also occasionally leads to problems when the remaining free portion 17 of the piece of cut packaging film 14 is received by a wrapping rod 30 (cf. FIG. 2).

Figure 2:
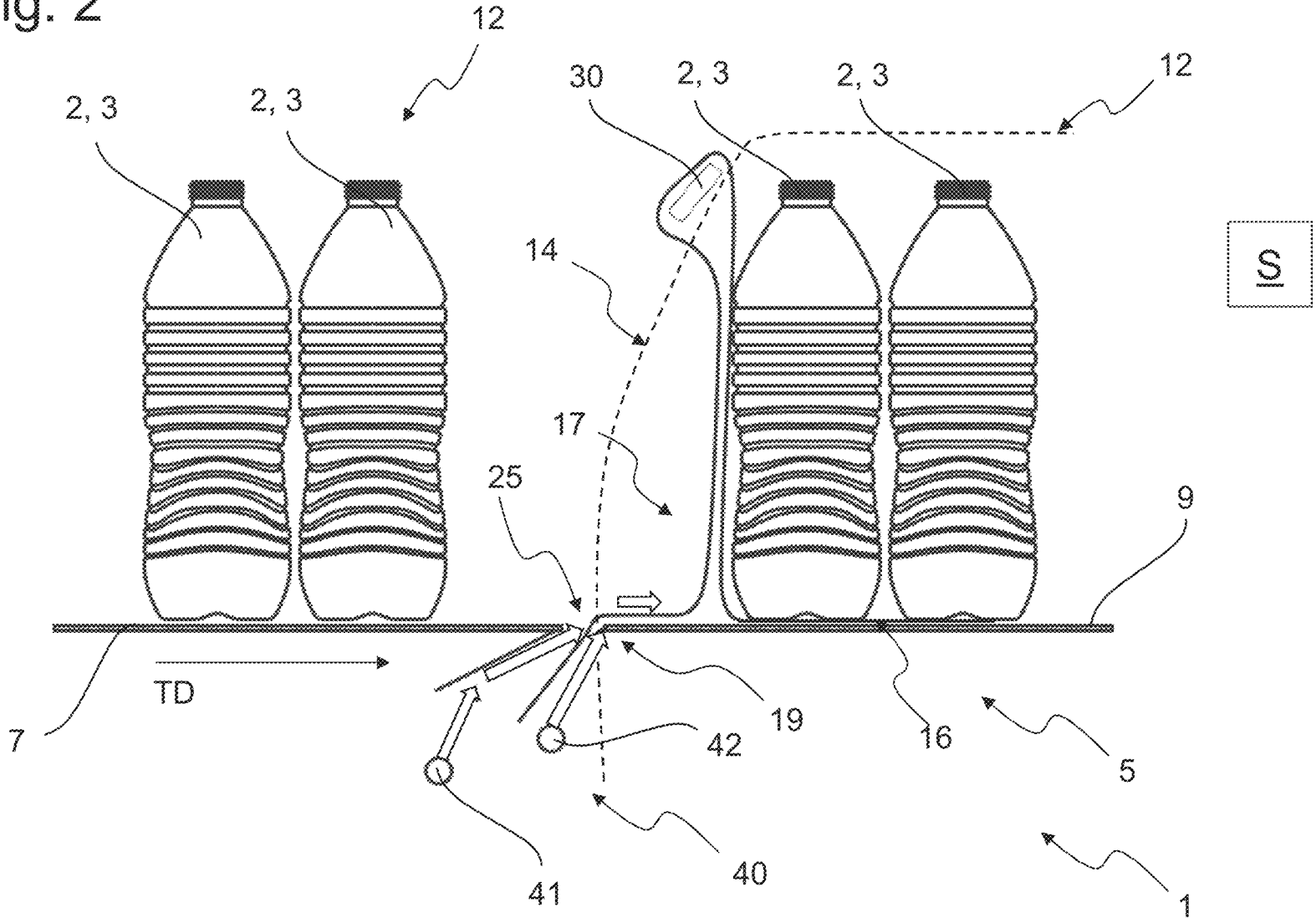
FIG. 2 is a schematic view of an embodiment of a device according to the invention and illustrates steps that may be provided in various embodiments of the method according to the invention.

By the embodiment of the device 1 according to the invention shown in FIG. 2, it is possible to increase throughput and to further reduce the relative distance RD at which successive groups of articles 12 are moved in the transport direction TD.

The embodiment shown in FIG. 2 of a device 1 according to the invention also comprises a horizontal conveyor 5, which comprises a first transport apparatus 7 and a second transport apparatus 9. Packaging film blanks 14 are introduced into a transport path of the groups of articles 12 via a feed apparatus 15 (cf. FIG. 3) (not shown in FIG. 2 for reasons of clarity). For this purpose, a gap 25 is formed between the first transport apparatus 7 and the second transport apparatus 9. A transport direction of the horizontal conveyor 5 is further indicated by TD in FIG. 2. The group of articles 12 shown on the right in FIG. 2 has already moved onto a portion 16 of the piece of cut packaging film 14. In addition, in FIG.

2, a rotatably driven or rotating wrapping rod 30 has already received the remaining free portion 17 of the packaging film blank 14 such that, in the position of the wrapping rod 30 according to FIG. 2, the remaining free portion 17 is supported so as to hang down from the wrapping rod 30. In FIG. 2, only one wrapping rod 30 is shown. However, a plurality of rotating wrapping rods 30 are provided, whereby, according to the illustration in FIG. 2, exactly one wrapping rod 30 taking up a remaining free portion 17 of a packaging film blank 14 and then guiding it around the group of articles 12 each time.

The device 1 of the embodiment according to FIG. 2 differs from the device 1' already known from the prior art, as is shown in FIG. 1, by the flow generating apparatus 40, which is arranged below a transport plane for groups of articles 12 formed by the horizontal conveyor 5.

In the present case, the flow generating apparatus 40 comprises at least one first nozzle 41 and at least one second nozzle 42, each of which is designed to deliver an air flow. The main flow direction of the delivered air flow is indicated in FIG. 2 by arrows. Furthermore, reference numeral 19 indicates an end region of the second transport apparatus 9. The air flow delivered by the at least one first nozzle is directed with its main flow direction toward this end region of the second transport apparatus 9, whereby the air flow moves along a surface of the second transport apparatus 9 and at least partially raises the remaining free portion 17 of the piece of cut packaging film 14 relative to the surface of the second transport apparatus 9. An air bed is thus formed on a surface of the second transport apparatus 9, on which the remaining free portion 17 of the piece of cut packaging film 14 is located. The air flow delivered by the at least one second nozzle 42 is also delivered by the at least one second nozzle 42 in such a way that this air flow comes into contact with a lower broad side surface of the remaining free portion 17.

Figure 3:
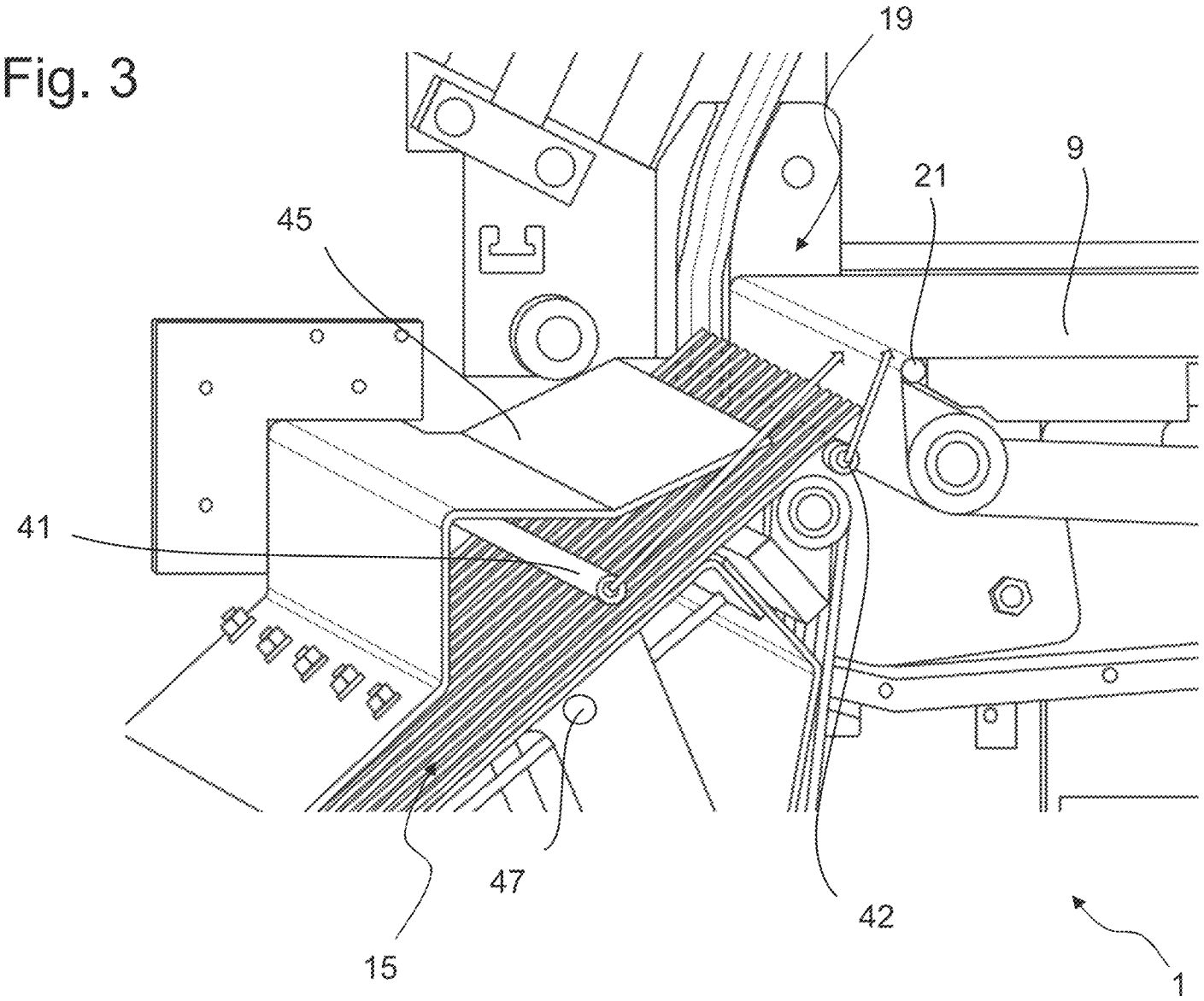
FIG. 3 is a perspective view of another embodiment of a device according to the invention and illustrates steps that may be provided in other embodiments of the method according to the invention.

Taking into account the air flow which is delivered by the at least one first nozzle 41, it can be seen in FIG. 3 that this flow is guided toward a flow baffle 45 by means of the at least one first nozzle 41. The flow baffle 45 is designed and arranged such that the air flow delivered by the at least one first nozzle 41 is deflected, whereby the air flow, after correspondingly being deflected, is directed with its main flow direction toward the end region 19 of the second transport apparatus 9. The air flow delivered by the at least one first nozzle 41 comes into contact with an upper broad side surface of the remaining free portion 17 and likewise follows the course of a surface of the second transport apparatus 9 after it has come into contact with the end region 19 of the second transport apparatus 9.

FIG. 2 shows that the remaining free portion 17 is blown toward the group of articles 12 in this case. A range of the remaining free portion 17 in the direction of the group of articles 12 shown on the left in FIG. 2 is thereby shortened, which can prevent the group of articles 12 shown on the left from unintentionally moving onto the remaining free portion 17 of the piece of cut packaging film 14. In addition, this provides the possibility of shortening the relative distance RD (cf. FIG. 1) between successive groups of articles 12 such that a relatively larger number of groups of articles 12 can be moved along the horizontal conveyor 5 per unit of time and the throughput of the device 1 when applying packaging film to groups of articles 12 is thereby increased. The at least one first nozzle 41 and/or the at least one second nozzle 42 can each be provided by a tube which has one or more openings for releasing at least one air flow. In particular, the tube can comprise such a number of openings that the remaining free portion 17 of the piece of cut packaging film 14 can be supplied with an airflow or with an air flow at least approximately over its entire width. Furthermore, further embodiments are conceivable in which the at least one first nozzle and/or the at least one second nozzle are not provided by a tube, but for example by a strip- or funnel-shaped structure. Such nozzles are known in the art and are therefore not listed exhaustively.

In the present case, the flow generating apparatus 40 is also connected to a control apparatus S. When the group of articles 12 shown on the left in FIG. 2 moves onto another piece of cut packaging film, it is initially not necessary or useful for an air flow to be delivered by the nozzles 41 and 42. The control apparatus S is thus able to control the flow generating apparatus 40 in such a way that the flow generating apparatus 40 generates an air flow intermittently and only at predetermined times in this case. For this purpose, the control apparatus S takes into account a transport speed of the horizontal conveyor 5.

FIG. 3 is a perspective view of another embodiment of a device 1 according to the invention and illustrates steps that may be provided in other embodiments of the method according to the invention. The embodiment according to FIG. 3 of a device 1 according to the invention further comprises a horizontal conveyor with a first and a second transport apparatus, with only the second transport apparatus 9 being shown here for reasons of clarity. The second transport apparatus 9 has a cylindrical deflection 21 which deflects a conveying means of the second transport apparatus 9, after which the conveying means is oriented horizontally and runs as a tight side or a driving side. The wrapping rods 30 formed as part of the device 1 according to FIG. 3 are not shown for reasons of clarity either.

One component of the device 1 is a feed apparatus 15, via which feed apparatus 15 pieces of cut packaging film 14 (cf. FIG. 2) can be introduced into the transport path of groups of articles 12 via the gap 25. As shown merely schematically in FIG. 3, the feed apparatus 15 comprises a steering apparatus 47. The steering apparatus 47 is provided for guiding pieces of cut packaging film 14 and comprises a surface which is curved at least in portions and across which an airflow passes. Each piece of cut packaging film 14 is moved along the steering apparatus 47 or along its surface, which is curved at least in portions and across which an airflow passes, before reaching the flow apparatus 40. The flow apparatus 40 comprises at least one first nozzle 41 and at least one second nozzle 42. The at least one first nozzle 41 and the at least one second nozzle 42 are each formed by a tube which may have one or more openings in order to deliver at least one air flow in each instance. The main flow direction of the air flow is also indicated in FIG. 3 by arrows. Thus, an air flow is delivered by the second nozzle 42 such that the main flow direction of the air flow is directed toward the deflection 21 arranged in the end region 19 of the second transport apparatus 9. The air flow delivered by the at least one first nozzle 41 is initially directed toward the flow baffle 45, which guides the air flow in such a way that its main flow direction is also directed toward the deflection 21 after contact with the flow baffle 45. The advantages and technical effects associated with the embodiment according to FIG. 2 are also present in the embodiment according to FIG. 3. Thus, an air flow directed with a main flow direction toward the end region 19 or toward the deflection 21 then moves along a surface of the second transport apparatus 9. As a result, a remaining free portion 17 of the piece of cut packaging film 14 is blown toward a group of articles 12, whereby the range of the remaining free portion 17 in the direction of a trailing group of articles 12 can be shortened and it is possible to move groups of articles 12 with a small relative distance RD (cf. FIG. 1) and thereby increase the throughput for the device 1 when applying packaging film to groups of articles 12.

The invention has been described with reference to a preferred embodiment. However, it is conceivable for a person skilled in the art that modifications or changes can be made to the invention without departing from the scope of protection of the following claims.

LIST OF REFERENCE SIGNS

1 Device
1' Device (prior art)
2 article
3 Beverage bottle
5 horizontal conveyor device
7 First transport apparatus
9 Second transport apparatus
12 Article group
14 Packaging film blank
15 Feed apparatus
16 Portion
17 Remaining free portion
18 Film bag
19 End region of the second transport apparatus 9
21 Deflection
25 Gap
30 Wrapping rod
40 Flow generating apparatus
41 First nozzle
42 Second nozzle
45 Flow baffle
47 Steering apparatus
RD Relative distance
TD transport direction

The invention claimed is:

1. A device (1) for applying packaging film to groups of articles (12), comprising:

at least one horizontal conveyor (5) that transports groups of articles (12), wherein the at least one horizontal conveyor (5) comprises a first transport apparatus (7) and a second transport apparatus (9), wherein the second transport apparatus (9) follows the first transport apparatus (7) in a transport direction (TD), and wherein a gap (25) is formed between the first transport apparatus (7) and the second transport apparatus (9), a feed apparatus (15) adapted to introduce pieces of cut packaging film (14) through the gap (25) and into a transport path of the groups of articles (12) such that the group of articles (12) moves onto a portion (16) of a piece of cut packaging film (14) and a remaining free portion (17) of each piece of cut packaging film (14) remains free from the group of articles (12), and a plurality of wrapping rods (30) which are moved in a rotary fashion so that the plurality of wrapping rods (30) take up and guide the remaining free portion (17) of each piece of cut packaging film (14) around the group of articles (12), a flow generating apparatus (40), having at least one first nozzle (41) and at least one second nozzle (42), adapted to generate at least one air flow, wherein the remaining free portion (17) of the piece of cut packaging film (14) is blown toward the group of articles (12) each time, and wherein each of the at least one first nozzle (41) and the at least one second nozzle (42) deliver at least one air flow, such that:

each of the at least one air flow is directed with its main flow direction toward an end region (19) of the second transport apparatus (9) arranged in a region of the gap (25), the at least one air flow delivered by the at least one first nozzle (41) impinges on a first broad side surface of the remaining free portion (17) of the piece of cut packaging film (14) which has already been taken up by a wrapping rod (30), and the at least one air flow delivered by the at least one second nozzle (42) impinges on a second broad side surface of the remaining free portion (17) of the piece of cut packaging film (14) which has already been taken up by a wrapping rod (30), which second broad side surface is opposite the first broad side surface.

2. The device (1) of claim 1, wherein the flow generating apparatus (40) comprises a first tube which forms the at least one first nozzle (41) or wherein the flow generating apparatus (40) comprises a second tube which forms the at least one second nozzle (42).

3. The device of claim 2, wherein the flow generating apparatus (40) comprises at least one flow baffle (45) which deflects the air flow delivered by the at least one first nozzle (41).

4. The device of claim 1, wherein the feed apparatus (15) comprises a steering apparatus (47) for guiding pieces of cut packaging film (14), wherein the steering apparatus (47) forms a surface which is curved at least in portions and across which an airflow passes, and along which steering apparatus (47) each piece of cut packaging film (14) is moved before it reaches the flow generating apparatus (40).

5. The device of claim 1, comprising a control apparatus (S) used to control the flow generating apparatus (40) for intermittently generating the at least one air flow.

6. The device (1) of claim 1 wherein the feed apparatus (15) is adapted to introduce pieces of thermoplastic packaging film.

7. A method for applying packaging film to groups of articles (12), comprising:

moving groups of articles (12) with at least one horizontal conveyor (5), wherein the at least one horizontal conveyor (5) comprises a first transport apparatus (7) and a second transport apparatus (9), wherein the second transport apparatus (9) follows the first transport apparatus (7) in a transport direction (TD), and wherein a gap (25) is formed between the first transport apparatus (7) and the second transport apparatus (9);

introducing, with a feed apparatus (15), a piece of cut packaging film (14) through the gap (25) and into a transport path of the groups of articles (12) wherein the group of articles (12) moves onto a portion (16) of the piece of cut packaging film (14) and wherein a remaining free portion (17) of the piece of cut packaging film (14) remains free from the group of articles (12);

providing a plurality of wrapping rods (30), each wrapping rod (30) receiving the remaining free portion (17) of the piece of cut packaging film (14) and guiding it around the group of articles (12), and blowing the remaining free portion (17) of the piece of cut packaging film (14), which has already been taken up by a wrapping rod (30), toward the group of articles (12) by at least one air flow provided by a flow generating apparatus (40) including at least one first nozzle (41) and at least one second nozzle (42), and delivering, with each of the at least one first nozzle (41) and the at least one second nozzle (42), at least one air flow, such that:

each of the at least one air flow is directed with its main flow direction toward the end region (19) of the second transport apparatus (9) arranged in a region of the gap (25), the at least one air flow delivered by the at least one first nozzle (41) impinges on a first broad side surface of the remaining free portion (17) of the piece of cut packaging film (14) which has already been taken up by the wrapping rod (30), and the at least one air flow delivered by the at least one second nozzle (42) impinges on a second broad side surface of the remaining free portion (17) of the piece of cut packaging film (14) which has already been taken up by the wrapping rod (30), which second broad side surface is opposite the first broad side surface.

8. The method of claim 7, wherein the flow generating apparatus (40) has at least one flow baffle (45) which deflects the air flow delivered by the at least one first nozzle (41).

9. The method of claim 7, wherein the feed apparatus (15) comprises a steering apparatus (47) for guiding pieces of cut packaging film (14), which steering apparatus (47) forms a surface which is curved at least in portions and across which an airflow passes, and along which steering apparatus (47) each piece of cut packaging film (14) moves before it reaches the flow generating apparatus (40).

* * * * *